United States Patent [19]
Itoga et al.
[11] 4,256,773
[45] Mar. 17, 1981

[54] BROMINATED CARBONACEOUS MOLECULAR SIEVE AND METHOD OF USE THEREFOR

[75] Inventors: Kiyoshi Itoga; Fumiichi Ogino, both of Kawanishi; Kinichi Shirakawa; Yasuyuki Soga, both of Takatsuki, all of Japan

[73] Assignees: Takeda Chemical Industries, Ltd.; Rengo Co., Ltd., both of Osaka, Japan

[21] Appl. No.: 957,205

[22] Filed: Nov. 3, 1978

[30] Foreign Application Priority Data

Nov. 7, 1977 [JP] Japan ..... 52/133817

[51] Int. Cl.[3] ..... A23B 7/00; B65B 55/00

[52] U.S. Cl. ..... 426/415; 47/58; 55/75; 55/389; 252/441; 252/444; 423/245; 426/419

[58] Field of Search ..... 426/124, 316, 318, 324, 426/541, 615, 410, 415, 419; 55/71, 74, 75, 387, 389; 252/441, 444; 423/245 S, 219; 47/58; 206/205

[56] References Cited

U.S. PATENT DOCUMENTS

| | | | |
|---|---|---|---|
| 2,394,887 | 2/1946 | Berl | 423/245 S |
| 3,313,630 | 4/1967 | Harvey | 426/419 X |
| 3,798,333 | 3/1974 | Cummin et al. | 426/316 X |
| 3,958,028 | 5/1976 | Burg | 426/419 X |
| 4,079,152 | 3/1978 | Bedrosian et al. | 426/124 |

FOREIGN PATENT DOCUMENTS

| | | |
|---|---|---|
| 48-8508 | 3/1973 | Japan . |
| 49-15749 | 10/1974 | Japan . |

*Primary Examiner*—Arthur L. Corbin
*Attorney, Agent, or Firm*—Wenderoth, Lind & Ponack

[57] ABSTRACT

A closable container in which is enclosed brominated carbonaceous molecular sieve having micropores within the range of 4 to 6 Angstrom units in diameter and a method for prolonging the shelf-lives of green perishable foods and flowers by the use of said container.

9 Claims, 1 Drawing Figure

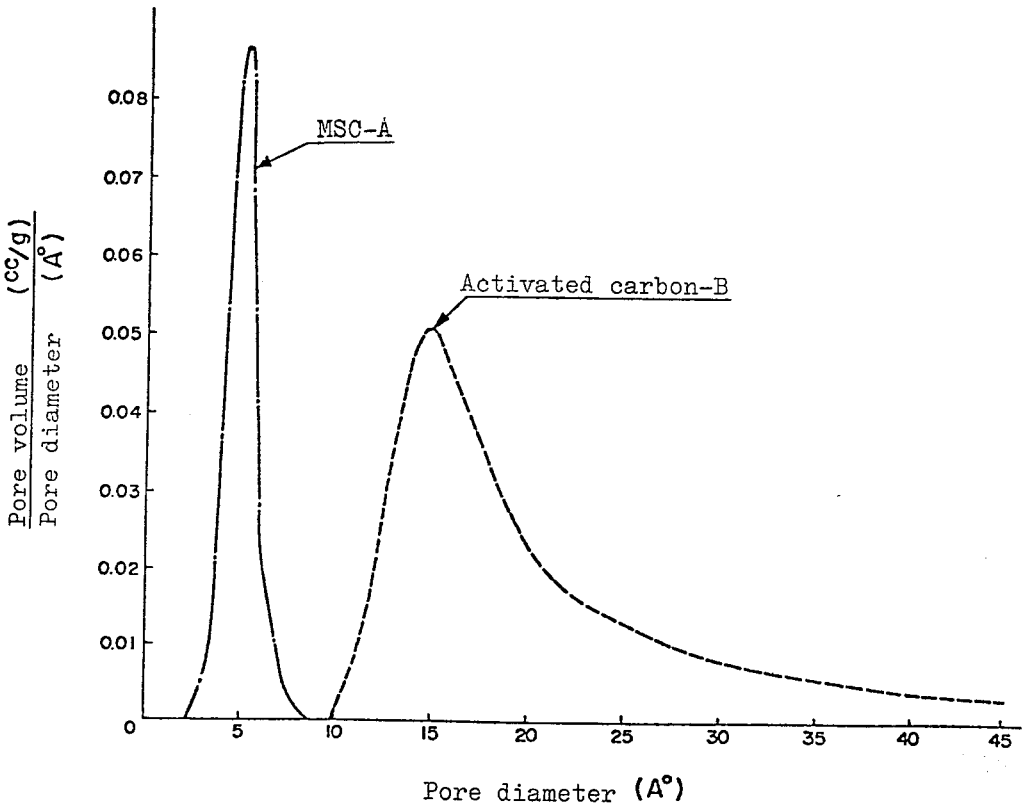
MSC-A
Activated carbon-B
Pore volume (cc/g) / Pore diameter (A°)
0.08
0.07
0.06
0.05
0.04
0.03
0.02
0.01
0
5
10
15
20
25
30
35
40
45
Pore diameter (A°)

BROMINATED CARBONACEOUS MOLECULAR SIEVE AND METHOD OF USE THEREFOR

This invention relates to a closable container in which is enclosed carbonaceous molecular sieve which carries bromine as adsorbed thereon and has micropores within the range of 4 to 6 Angstrom units (hereinafter referred to as brominated carbonaceous molecular sieve) and to a method for prolonging the shelf-lives of green perishable foods or flowers by the use of said container.

The term "prolonging the shelf-lives of green perishable foods and flowers" or any term equivalent thereto as used herein means retarding the post-harvest ripening or spoiling of green perishable foods, and maintaining freshness of them, and retarding the unfolding of a flower bud as well as keeping the flower life as long as possible.

It has been a conventional practice to enclose a green perishable foodstuff in a closed packaging material for the purpose of keeping the foodstuff fresh during the storage or transit thereof. Since the supply of endogenous oxygen into the package is then depressed, the respiration of the green perishable foodstuff is suppressed and, hence, the spoilage or staling thereof is somewhat retarded. However, this method is not satisfactory altogether, for the ethylene, which is known to be a promoter of the post-harvest ripening of plant life, emanates from the green perishable foodstuff itself to fill the internal space of the package and, thereby, to accelerate changes in the color and a further ripening of the foodstuff. An attempt has also been made to remove the ethylene by adsorption by enclosing activated carbon within said closed package or container. However, this method is not fully satisfactory, either. Moreover, because in this method, the aromatic substances emanating from the green perishable foodstuff are also removed by adsorption, the foodstuff does not give off its characteristic aroma upon unpackaging, thus detracting from the salability of the foodstuff.

The research undertaken by us for overcoming the above disadvantages led us to the finding that by allowing a special carbonaceous molecular sieve to be present in a closed package or container housing a green perishable foodstuff or a flower, the over-ripening promoter ethylene can be selectively removed by a process of adsorption without loss of the intrinsic aroma of the foodstuff and flower, thus ensuring a better prolongation of the shelf-life of the foodstuff and flower than any of the prior art methods.

The brominated carbonaceous molecular sieve employed according to this invention is prepared by causing bromine to be adsorbed on a carbonaceous molecular sieve having micropores in the range of 4 to 6 Angstrom units in diameter.

The aforesaid cabonaceous molecular sieve contains no less than 90 percent of carbon, no more than 3 percent of oxygen and no more than 1 percent of hydrogen, has a surface area of 400 to 900 $m^2/g$ and includes micropores such that no less than 80 percent of the total volume of said micropores is accounted for by micropores of diameters within the range of 4 t 6 Angstrom units. Such a special carbonaceous molecular sieve can be prepared, for example by the method described in Japanese Pat. No. 49–37036, that is to say by adsorbing starting materials capable of polymerizing and/or condensing to yield a phenolic resin or furan resin on a carbonaceous adsorbent material, causing said starting materials to polymerize and/or condense in situ and heating the thus-treated carbonaceous adsorbent material at a temperature between about 400° C. and about 1,000° C.

While said carbonaceous adsorbent material may be any porous carbonaceous material having an adsorptive capacity, normally activated carbon and other materials having the like properties are preferably employed. Thus, it is desirable to employ a carbonaceous material which has a high adsorptive affinity for the starting materials, has a porosity distribution such that micropores of not more than 20 Angstrom units in diameter account for a large proportion of the total porosity, and comprises tough granules having a high grain hardness. The starting materials to be adsorbed on said carbonaceous adsorbent material are the materials which will polymerize and/or condense to yield phenolic resins, i.e. phenol and analogs, such as phenol, cresol, xylenol, etc., on the one hand and aldehydes such as formaldehyde, acetaldehyde, benzaldehyde, furfural, etc., or the materials which will polymerize and/or condense to yield furan resins, i.e. furfuryl alcohol or furfural. These materials may be used alone or in suitable combinations. The amounts of those starting materials are preferably selected in such a manner that the carbon fixation by the resin produced from the starting materials adsorbed on the carbonaceous adsorbent material will be within the range of about 0.1 to about 1.0 gram and, for still better results, about 0.3 to about 0.7 g per cubic centimeter of the micropores of not more than 300 Angstrom units. For this purpose, it is normally desirable to employ about 0.1 to 2.0 grams, preferably 0.3 to 1.5 g., of said starting materials per cubic centimeter of micropores of not more than 300 Angstrom units in said carbonaceous adsorbent material.

These starting materials may be used after admixing with carbon sources such as lignin, pitch, carbohydrates, etc. and/or carbon fixatives such as aromatic nitro compounds. A catalyst is preferably employed in polymerizing and/or condensing said starting materials onto activated carbon. The catalyst may be any of the catalysts commonly employed. Thus, with respect to starting materials for the production of a phenolic resin, there may be mentioned alkaline catalysts such as sodium hydroxide, potassium hydroxide, barium hydroxide, ammonia, etc. or acid catalysts such as hydrochloric acid, nitric acid, sulfuric acid, phosphoric acid, boric acid, oxalic acid, succinic acid, etc. With respct to starting materials for the production of a furan resin, there may be mentioned acids such as hydrochloric acid, nitric acid, sulfuric acid, phosphoric acid, oxalic acid, succinic acid, boric acid, or acidic salts such as zinc chloride, magnesium chloride, etc. With respect to phenolic resins, alkaline catalysts are preferred. The amount of the catalyst is desirably selected from within the following range, with respect to the starting materials for the resin.

Phenolic resins:
Alkali catalysts: 1 to 10%
Acid catalysts: 2 to 30%
Furan resins:
Acid catalysts: 10% or less The starting materials for said phenolic resin or furan resin are diluted with a suitable solvent such as water, methanol, benzene or creosote oil and the carbonaceous adsorbent material is sprayed with, or dipped in, the resultant solution to cause the starting materials to be adsorbed and supported on the adsorbent. Alternatively, said starting materials may be adsorbed and supported in gaseous phase on the carbonaceous adsorbent. When a catalyst is employed, the catalyst may be first adsorbed and supported on the adsorbent and the starting materials next adsorbed and supported. The procedure may be reversed so that the adsorption of the starting materials will take place first. As a further alternative, both the starting materials and catalyst may be simultaneously adsorbed and supported. It is, however, most desirable that the catalyst and starting materials be supported in the order mentioned. The supporting operation may be carried out in two or more steps and, in doing so, the starting materials and catalyst may be adsorbed in an optional sequence and in optional combinations. In the method of this invention the heat of adsorption evolved in the course of adsorption of starting materials on the carbonaceous adsorbent sets off a polymerization and/or condensation reaction of the starting materials, but the polymerization and/or condensation reaction may be hastened, if necessary, by heating the system to a temperature not exceeding 200° C.

By this heating, the solvent and some of unreacted components are desorbed and evaporated off. The carbonaceous adsorbent thus treated is then subjected to a carbonization treatment. This carbonization treatment is carried out in the same manner as the usual carbonization of activated carbon. Thus, the substrate adsorbent may be carbonized either directly or after it has been pre-oxidized. The pre-oxidation treatment may be carried out by treating the adsorbent in an oxygen-containing atmosphere at low temperature. The carbonization treatment may be carried out, for example, by heating the adsorbent by means of a heater in streams of an inert gas, e.g. $N_2$, $H_2$, He, CO, $CO_2$ or $SO_2$, or in vacuo at a temperature between 400° to 1,000° C.

The atmosphere may contain a minor amount of oxygen. To retard the degradation rate of the resin, the heating rate is preferably about 50° C./hr. to 400° C./hr. in most instances. The carbonaceous molecular sieve thus obtained has micropores, the large majority of which have pore diameters within the range of 4 to 6 Angstrom units. A typical relation of micropore diameters with the total volume of micropores may be represented by the curve MSC-A in the drawing. As shown by the curve for Activated Carbon-B, the prior art activated carbon has larger pore diameters and a broader pore diameter distribution.

The carbonaceous molecular sieve prepared as above may be put to use, for example in such forms as spherical or cylindrical molded pellets, irregular crushed fragments or other granulated forms, powdery forms and other forms and particle sizes suited for the intended applications.

The carbonaceous molecular sieve may be directly used in the process for bromine adsorption. Or, prior to the adsorption of bromine, a small amount of phosphoric acid, boric acid or a salt thereof may be previously adsorbed and supported. By this prior treatment with such acid or salt, the aging loss of the property of the brominated carbonaceous molecular sieve of this invention to maintain the green perishable foodstuffs and flowers can be further retarded.

To support such additional substances, the carbonaceous molecular sieve is sprayed with or immersed in an aqueous solution containing such a substance in a suitable concentration. The amount supported of such additional substances is normally 0.02 to 2 weight % and preferably 0.05 to 1 weight percent. The amount of bromine to be adsorbed on the carbonaceous molecular sieve is 2 to 30 weight % and preferably 5 to 20 weight %.

The adsorption of bromine on the carbonaceous molecular sieve may be achieved by any of such known procedures as (1) the gas-phase adsorption process in which a carrier gas containing bromine gas is contacted with the carbonaceous molecular sieve, (2) the liquid-phase adsorption process in which the carbonaceous molecular sieve is immersed in aqueous bromine and (3) the spray adsorption process in which the carbonaceous molecular sieve is directly sprayed with liquid bromine, although the gas-phase adsorption process is most desirable.

In the above-mentioned gas-phase adsorption process, the carrier gas may for example be air, nitrogen or carbon dioxide gas. As to the mixing ratio of bromine gas to such a carrier gas, the concentration of bromine gas is normally not more than 30 volume % and preferably 0.05 to 2 volume %. The contacting temperature is not more than 150° C. and preferably not more than 80° C. Since the heat of adsorption is evolved in the course of adsorption, the contacting procedure and the temperatures of the gas and of the adsorption vessel are preferably selected so that the temperature of the system will not rise beyond 150° C. An exemplary procedure may thus be a continuous gas-phase adsorption process in which a bromine-containing gas is circulated through a fluidized bed, moving bed or jet bed of said carbonaceous molecular sieve. Preferably, the brominated carbonaceous molecular sieve obtained by the above bromine-adsorption process is further treated with the passage of a bromine-free carrier gas therethrough at a temperature not exceeding 100° C. so that unadsorbed bromine will be stripped off.

In the liquid-phase adsorption process, the carbonaceous molecular sieve is immersed in an aqueous solution of bromine containing about 2 to 3% of bromine at a temperature not exceeding 50° C., preferably below 30° C., for about 1 to 10 hours and, after this adsorption process, the brominated carbonaceous molecular sieve is separated by filtration or other procedure and dried. In this manner, also, there is obtained the brominated carbonaceous molecular sieve to be employed according to this invention.

In the process comprising spraying the carbonaceous molecular sieve with liquid bromine, the desired brominated carbonaceous molecular sieve can be prepared by spraying the carbonaceous molecular sieve directly with liquid bromine under constant stirring and, if necessary, drying the treated molecular sieve. The temperature at which liquid bromine is sprayed is preferably not more than 50° C.

The closable container mentioned hereinbefore may be formed by a material having a carbon dioxide gas permeability at 25° C. of 5,000 to 100,000 ml/m$^2$/24 hrs., preferably 10,000 to 70,000 ml/m$^2$/24 hrs. and an oxygen permeability at 25° C. of 2,000 to 50,000 ml/m$^2$/24 hrs., preferably 3,000 to 30,000 ml/m$^2$/24 hrs. As examples of such a material there may be mentioned films and sheets of polyethylene, polypropylene, EVA(ethylene-vinyl acetate copolymer) and other plastics. While such films and sheets may vary in thickness according to various conditions of use, e.g. foodstuffs or flowers to be protected, the quantities thereof, etc., the range of about 10 to 100$\mu$ is suitable and about 15 to 70$\mu$ is more suitable. To produce a container, the material may be formed into a bag and the opening thereof closed with a rubber band or cord or heat-sealed or, alternatively, the material may be folded by the so-called handkerchief method. From a shipping point of view, it is advantageous to employ such a material in conjunction with a corrugated board box, or a corrugated board box fabricated by laminating said material to a board material in the manner of surfacing or interlining.

In the practice of the method of this invention, the atmosphere within the closed container has an appreciable influence upon the retention of freshness of the green perishable foodstuff and the flower contained therein. Although it depends upon the kind of foodstuff and flower, the internal atmosphere of the closed package desirably has a carbon dioxide concentration of 2 to 13%, preferably 4 to 7%, an oxygen concentration of 1 to 15%, preferably 3 to 8%, a relative humidity of 70 to 99%, preferably 75 to 95% and a temperature of 0° to 35° C., preferably 0° to 10° C.

If the carbon dioxide gas concentration of the closed container is low and the oxygen gas concentration thereof is high, there will be obtained no adequate CA effect (the effect of retaining the freshness of a green perishable foodstuff and flower through a slowdown in their respiration which can be caused by adjusting the concentration of oxygen and carbon dioxide in the ambient atmosphere.)

Conversely, if the carbon dioxide concentration in the closed container is high and the oxygen concentration thereof is low, there are caused the so-called gas injuries such as browning as well as such troubles as alcohol fermentation. Therefore, in consideration of the kind and amount of green perishable foodstuff and flowers, the type and thickness of the container material are selected from the ranges indicated hereinbefore so that the atmosphere in the closed container will satisfy the conditions set forth above.

While the amount of the brominated carbonaceous molecular sieve in the closed package should vary with such variables as the kind and quantity of the green perishable foodstuff, it is normally within the range of 0.5 to 30 grams and preferably 1 to 10 grams per kilogram of the foodstuff. There is no limitation on the form in which the brominated carbonaceous molecular sieve is present in the closed container. Thus, for example, it is an expedient procedure to include about 1 to 50 grams of the brominated carbonaceous molecular sieve in a container made of an air-permeable material such as paper, cloth, nonwoven fabric or the like, or fix the brominated carbonaceous molecular sieve securely to the internal wall of a closable container.

While this invention is applicable to all varieties of green perishable foodstuffs and flowers, it is particularly useful for prolonging the shelf-lives of fruits such as apple, pear, mandarin orange, persimmon, loquat, peach, banana, grape, cherry, etc., and vegetables such as bamboo shoots, mushrooms (*Cortinellus shiitake*), spinach, leek, lettuce, cabbage, tomato, cucumber, strawberry, green pepper, etc., and flowers such as carnations, tulips, chrysanthemums, orchids, roses, etc.

In accordance with this invention, because the brominated carbonaceous molecular sieve enclosed in the closed container selectively adsorbs low molecular weight substances inclusive of ethylene, among the substances, emanated from green perishable foodstuffs and flowers, which include not only ethylene but aldehydes, alcohols and so forth, the effect of adsorptive removal of ethylene lasts a long time even when the molecular sieve is used in a small amount. Moreover, because esters and other aromatic components are not adsorbed, the characteristic aromas of green perishable foodstuffs and flowers remain unabated or otherwise unaffected until the time when the packages are opened.

The following examples are intended to illustrate this invention in further detail.

EXAMPLE 1

Ten (10) kilogram each of apples (Star-King) just harvested are packaged air-tight in polyethylene films as thick as 30μ. Then, activated coconut shell carbon (Takeda Chemical Industries, Ltd., Granular Shirasagi® GX 4/6, analysis-C 93%, O 3%, H 0.8%, ashes 2%; surface area 1150 $m^2/g$; volume % of 4–6 Å micropores based on total porosity—6%) or a brominated carbonaceous molecular sieve [Granular Shirasagi® MSC 5 A, a carbonaceous molecular sieve (Takeda Chemical Industries, Ltd., analysis—C 95%, O 2%, H 0.8%, ashes 1.5%; surface area 600 $m^2/g$; volume % of 4–6 Å micropcres based on total porosity—93%) brominated by spraying liquid bromine to support 10% of bromine] was enclosed in the package which then was sealed and stored in a refrigerator at 1° C. for 4 months.

At intervals of 30 days the ethylene concentration in each sealed package was measured and the results were compared.

The data are set forth in Table 1.

TABLE 1

| Sample No. | Type of film | Adsorbent | Amount (g) | Ethylene concentration (ppm) After 30 days | After 60 days | After 90 days | After 120 days |
|---|---|---|---|---|---|---|---|
| 1 | Polyethylene | None | 0 | 253 | 145 | 106 | 93 |
| 2 | Polyethylene | Activated carbon, coconut shell | 100 | 187 | 103 | 86 | 74 |
| 3 | Polyethylene | Brominated carbonaceous molecular sieve | 100 | 7 | 9 | 13 | 16 |

It is apparent from these results that in the method of this invention involving the use of brominated carbonaceous molecular sieve, the concentration of ethylene in the sealed polyethylene film package containing apples is markedly lower than the results for other storage methods.

EXAMPLE 2

One (1) kilogram each of grapes (Kyoho) just harvested were packaged in polyethylene film and the same activated coconut shell carbon and brominated carbonaceous molecular sieve as those used in Example 1 were respectively enclosed in the packages. The packages were sealed and stored at atmospheric temperature (average atmospheric temperature 24.3° C.)

After 6 days of storage, each package was opened and the qualities of the grapes were investigated. The results are set forth in Table 2.

TABLE 2

| Sample No. | Packaging material | Type of adsorbent | Wt. of absorbent (g) | % Removal of berries | Browning of stalks | Acidity* | Taste |
|---|---|---|---|---|---|---|---|
| 1 | Polyethylene | — | — | 43 | 19 | 0.83 | Poor |
| 2 | Polyethyl- | Activated | 10 | 35 | 11 | 0.89 | Slightly |
| 3 | ene Polyethylene | carbon Brominated carbonaceous molecular sieve | 10 | 4 | 2 | 1.12 | poor Good |

*Acidity: The fruit juice was titrated with 1/10 N-sodium hydroxide and the result was expressed in the % of tartaric acid per 100 ml.

EXAMPLE 3

In each of the bags made of 15μ–60μ thick films of various plastic materials, i.e. polyethylene, ethylenevinyl acetate copolymer, polyvinyl chloride and polycarbonate, there were enclosed 10 kg of pears just harvested (variety: Shinsui; fruit color index 3.0) together with 30 g of the same brominated carbonaceous molecular sieve as that used in Example 1. Each of these bags was sealed and put in a corrugated board box which then was stored at room temperature (average atmospheric temperature 28.5° C.) After 10 days each bag was taken out, opened and investigated for the quality of the contents.

The results are set forth in Table 3.

For a salability (marketability) assessment, each sample was tested and rated according to the following scheme.

O = the sample which satisfied all of the five requirements: fruit color index 3.5 or less; blackening rate, 15% or less; internal break-down rate, 15% or less; acidity (total acid), not less than 1.40 ml; alcohol odor, weak or negligible.

Δ = The sample which satisfied 3 or 4 of the five requirements.

X = The sample which satisfied 2 or less of the five requirements.

TABLE 3

| Sample No. | Type of film | Thickness (μ) | Permeability to $CO_2$ ($ml/m^2$/24 hrs) | Composition of gas and moisture in sealed package: $CO_2$ (%) | $O_2$ (%) | $H_2O$ (%) | Brominated molecular sieve carbon, weight (g) | Fruit color index*1 | Blackening rate (%)*2 | Internal breakdown rate (%)*3 | Total acid (ml)*4 | Alcohol odor | Salability |
|---|---|---|---|---|---|---|---|---|---|---|---|---|---|
| 1 | Control (ordinary corrugated carton) | — | — | — | — | — | 0 | 5.0 | 98 | 43 | 1.10 | Appreciable | X |
| 2 | Polyethylene | 30 | 33,000 | 6.3 | 5.7 | 92 | 0 | 4.0 | 13 | 39 | 1.30 | Appreciable | X |
| 3 | Ethylene -vinyl acetate copolymer | 15 | 81,000 | 2.6 | 10.1 | 71 | 30 | 4.0 | 11 | 11 | 1.45 | None | Δ |
| 4 | Ethylene -vinyl acetate copolymer | 20 | 63,000 | 4.1 | 7.8 | 88 | 30 | 3.5 | 6 | 8 | 1.60 | None | |
| 5 | Polyethylene | 30 | 33,000 | 5.7 | 6.6 | 90 | 30 | 3.5 | 0 | 6 | 1.60 | None | |
| 6 | Polyethylene | 60 | 16,000 | 7.0 | 4.9 | 94 | 30 | 3.5 | 0 | 6 | 1.55 | None | |
| 7 | Polyvinyl chloride | 20 | 12,000 | 10.1 | 3.2 | 95 | 30 | 3.5 | 0 | 9 | 1.50 | Sparse | |
| 8 | Polyvinyl chloride | 30 | 7,200 | 12.6 | 1.7 | 97 | 30 | 3.5 | 0 | 9 | 1.40 | Moderate | Δ |

*1A five-point scale of 5.0 for over-ripened; 4.0 for slightly over-ripened; 3.0 for appropriately ripened; 2.0 for slightly under-ripened; 1.0 for under-ripened.
*2The number of pears with blackened fruit surfaces or blackened fruit corky spots is shown in percentage based on the total number of pears.
*3The number of browned cores is shown in percentage based on the total number of pears.
*4The amount of 1/10N-NaOH required to neutralize 10 ml of fruit juice is expressed in ml.

As shown in Table 3, the freshness of pears (Shinsui) in terms of appearance, fruit pulp and taste could be well maintained by the use of brominated carbonaceous molecular sieve.

What is claimed is:

1. A closable container in which is enclosed carbonaceous molecular sieve which carries bromine as adsorbed thereon and has micropores within the range of 4 to 6 Angstrom units in diameter.

2. A closable container according to claim 1 wherein said closable container is made of material whose permeability to carbon dioxide gas at 25° C. is in the range of 5,000 to 100,000 $ml/m^2/24$ hours.

3. A closable container according to claim 1 wherein said carbonaceous molecular sieve contains no less than 90% of carbon, no more than 3% of oxygen and no more than 11% of hydrogen, and has a surface area of 400 to 900 $m^2/g$, and no less than 80% of the total volume of said micropores is accounted for by micropores of diameters within the range of 4 to 6 Angstrom units.

4. A closable container according to claim 3 wherein the amount of bromine adsorbed on said carbonaceous molecular sieve is 2 to 30 weight %.

5. A method for prolonging the shelf-lives of green perishable foods or flowers which comprises enclosing a green perishable food or flower and a carbonaceous molecular sieve, which carries bromine as adsorbed thereon and has micropores within the range of 4 to 6 Angstrom units in diameter, in a closable container.

6. A method according to claim 5 wherein said closable container is made of material whose permeability to carbon dioxide gas at 25° C. is in the range of 5,000 to 100,000 ml/m$^2$/24 hours.

7. A method according to claim 5 wherein the amount of said carbonaceous molecular sieve is in the range of 0.5 to 30 grams per kilogram of said green perishable food or flower.

8. A method according to claim 5 wherein said carbonaceous molecular sieve contains no less than 90% of carbon, no more than 3% of oxygen and no more than 1% of hydrogen, and has a surface area of 400 to 900 m$^2$/g, and no less than 80% of the total volume of said micropores is accounted for by micropores of diameters within the range of 4 to 6 Angstron units.

9. A method according to claim 8 wherein the amount of bromine adsorbed on said carbonaceous molecular sieve is 2 to 30 weight %.

* * * * *